US011024981B2

(12) United States Patent
Chiang et al.

(10) Patent No.: US 11,024,981 B2
(45) Date of Patent: Jun. 1, 2021

(54) MULTI-BAND ENDFIRE ANTENNAS AND ARRAYS

(71) Applicant: MediaTek Inc., Hsinchu (TW)

(72) Inventors: Chung-Hsin Chiang, Hsinchu (TW); Yeh-Chun Kao, Hsinchu (TW); Shih-Huang Yeh, Hsinchu (TW); Chen-Fang Tai, Hsinchu (TW)

(73) Assignee: MediaTek Inc., Hsinchu (TW)

( * ) Notice: Subject to any disclaimer, the term of this patent is extended or adjusted under 35 U.S.C. 154(b) by 0 days.

(21) Appl. No.: 16/378,281

(22) Filed: Apr. 8, 2019

(65) Prior Publication Data

US 2019/0319369 A1 Oct. 17, 2019

Related U.S. Application Data

(60) Provisional application No. 62/657,093, filed on Apr. 13, 2018.

(51) Int. Cl.

| | |
|---|---|
| ***H01Q 21/28*** | (2006.01) |
| ***H01Q 9/18*** | (2006.01) |
| ***H01Q 7/00*** | (2006.01) |
| ***H01Q 21/00*** | (2006.01) |
| ***H01Q 21/06*** | (2006.01) |
| ***H01Q 9/28*** | (2006.01) |
| ***H01Q 9/16*** | (2006.01) |

(52) U.S. Cl.

CPC ..... *H01Q 21/28* (2013.01); *H01Q 7/00* (2013.01); *H01Q 9/16* (2013.01); *H01Q 9/18* (2013.01); *H01Q 9/285* (2013.01); *H01Q 21/0006* (2013.01); *H01Q 21/067* (2013.01)

(58) Field of Classification Search

CPC ..... H01Q 21/067; H01Q 5/48; H01Q 9/065

See application file for complete search history.

(56) References Cited

U.S. PATENT DOCUMENTS

| | | | | |
|---|---|---|---|---|
| 5,485,167 | A | 1/1996 | Wang | |
| 6,816,124 | B2 | 11/2004 | Tillery | |
| 7,830,312 | B2 * | 11/2010 | Choudhury | H01Q 3/26 343/700 MS |
| 9,819,098 | B2 * | 11/2017 | Gu | H01Q 1/2283 |
| 10,084,241 | B1 * | 9/2018 | Jenwatanavet | H01Q 1/38 |
| 10,153,557 | B2 * | 12/2018 | Sudo | H01Q 1/38 |

(Continued)

FOREIGN PATENT DOCUMENTS

| | | | | |
|---|---|---|---|---|
| DE | 1930660 A1 * | 1/1971 | | H01P 5/10 |

*Primary Examiner* — Ab Salam Alkassim, Jr.
(74) *Attorney, Agent, or Firm* — Tong J. Lee

(57) ABSTRACT

An antenna assembly includes a first antenna element coupled to RF circuitry via a first feeder, and a second antenna element coupled to the RF circuitry via a second feeder. The first feeder and the second feeder have different shapes. The first antenna element and the second antenna element radiate in different frequency bands and in a direction parallel to a ground plane. The ground plane is disposed on at least one layer in a substrate that includes a plurality of layers parallel to one another. The first antenna element is disposed on first one or more of the layers and the second antenna element is disposed on second one or more of the layers, which are different from the first one or more of the layers. Another antenna assembly includes a first subarray of the first antenna elements and a second subarray of the second antenna elements.

10 Claims, 7 Drawing Sheets

(56) References Cited

U.S. PATENT DOCUMENTS 10,333,209 B2 * 6/2019 Schmalenberg ..... H01Q 3/28
10,862,211 B2 * 12/2020 Pu ..... H01Q 15/02
2009/0231225 A1 * 9/2009 Choudhury ..... H01Q 1/38 343/770
2010/0167666 A1 * 7/2010 Choudhury ..... H01L 23/49822 455/90.2
2011/0287731 A1 * 11/2011 Hase ..... H01Q 21/24 455/269
2013/0147664 A1 * 6/2013 Lin ..... H01Q 13/085 342/372
2013/0273858 A1 * 10/2013 Sover ..... H01Q 21/064 455/73
2013/0293420 A1 * 11/2013 Yehezkely ..... H01Q 21/061 342/372
2014/0253382 A1 * 9/2014 Markish ..... H01Q 1/48 342/385
2014/0320344 A1 * 10/2014 Sanderovich ..... H01Q 21/205 342/372
2015/0070228 A1 * 3/2015 Gu ..... H01Q 1/2283 343/727
2015/0148098 A1 * 5/2015 Grau Besoli ..... H01Q 1/007 455/553.1
2016/0248169 A1 * 8/2016 Mohammadian .... H01Q 21/065
2017/0012359 A1 * 1/2017 Jung ..... H01Q 3/30
2017/0062908 A1 * 3/2017 Sanderovich ..... H01Q 21/065
2017/0222325 A1 * 8/2017 Sudo ..... H01Q 9/0457
2017/0222333 A1 * 8/2017 Sudo ..... H01Q 13/08
2018/0090827 A1 * 3/2018 Lee ..... G01S 7/032
2018/0309186 A1 * 10/2018 Yu ..... H01Q 21/29
2019/0006751 A1 * 1/2019 Chen ..... H01Q 21/065
2019/0109386 A1 * 4/2019 Syrytsin ..... H01Q 5/371
2019/0207304 A1 * 7/2019 Kim ..... H01Q 21/08
2019/0288377 A1 * 9/2019 Ying ..... H01Q 19/06
2019/0326677 A1 * 10/2019 Yamamoto ..... H01Q 19/30
2019/0334233 A1 * 10/2019 Kim ..... H01Q 1/48
2020/0067188 A1 * 2/2020 Pu ..... H01Q 19/062
2020/0220268 A1 * 7/2020 Kim ..... H01Q 21/28
2020/0266523 A1 * 8/2020 Park ..... H01Q 1/48
2020/0303839 A1 * 9/2020 Kim ..... H01Q 1/2283
2020/0381835 A1 * 12/2020 Chou ..... H01Q 21/24
2020/0395677 A1 * 12/2020 Kim ..... H01Q 9/0414

* cited by examiner

MULTI-BAND ENDFIRE ANTENNAS AND ARRAYS

CROSS-REFERENCE TO RELATED APPLICATIONS

This application claims the benefit of U.S. Provisional Application No. 62/657,093 filed on Apr. 13, 2018, the entirety of which is incorporated by reference herein.

TECHNICAL FIELD

Embodiments of the invention relate to an antenna assembly that radiates in two or more frequency bands, in a direction parallel to a ground plane.

BACKGROUND

Wireless devices use antennas to transmit and receive wireless signals. Modern wireless devices, such as those operating in the 5G (fifth generation) mobile communication networks, use multi-band antennas capable of signaling (transmitting and/or receiving) at multiple frequency bands in the millimeter frequency spectrum (e.g., 24.0-300 GHz). Operation at these frequencies may encounter significant challenges. For example, millimeter wave communications typically do not navigate around or through obstacles effectively. Thus, millimeter wave signals may be substantially attenuated during signal propagations. In addition, many wireless devices, such as smartphone and smart watches, have a limited form factor which constrains the size of the antennas.

SUMMARY

In one embodiment, there is provided an antenna assembly comprising a first antenna element coupled to RF circuitry via a first feeder, and a second antenna element coupled to the RF circuitry via a second feeder. The first feeder and the second feeder have different shapes. The first antenna element and the second antenna element radiate in different frequency bands and in a direction parallel to a ground plane. The ground plane is disposed on at least one layer in a substrate that includes a plurality of layers parallel to one another. The first antenna element is disposed on first one or more of the layers and the second antenna element is disposed on second one or more of the layers, which are different from the first one or more of the layers.

In another embodiment, there is provided an antenna assembly comprising a first antenna subarray including a plurality of first antenna elements, each first antenna element coupled to RF circuitry via a first feeder; and a second antenna subarray including a plurality of second antenna elements, each second antenna element coupled to the RF circuitry via a second feeder. The first feeder and the second feeder have different shapes. The first antenna element and the second antenna element radiate in different frequency bands and in a direction parallel to a ground plane. The ground plane is disposed on at least one layer in a substrate that includes a plurality of layers parallel to one another. Each of the first antenna elements and the second antenna elements is disposed on one or more of the layers, and each first antenna element and a corresponding one of the second antenna elements are stacked in a perpendicular direction with respect to the ground plane.

Advantages of the embodiments will be explained in detail in the following descriptions.

BRIEF DESCRIPTION OF THE DRAWINGS

The present invention is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one. Further, when a particular feature, structure, or characteristic is described in connection with an embodiment, it is submitted that it is within the knowledge of one skilled in the art to effect such feature, structure, or characteristic in connection with other embodiments whether or not explicitly described.

DETAILED DESCRIPTION

Figure 1:
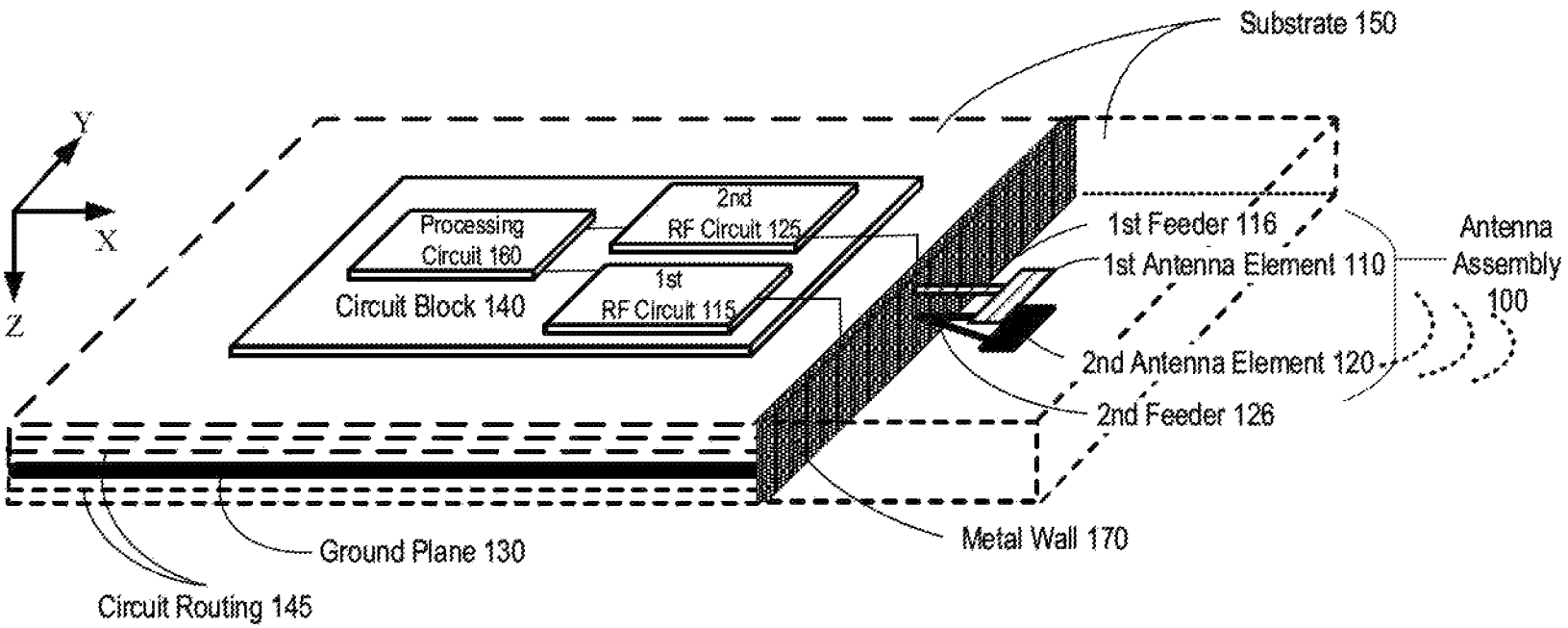
FIG. 1 illustrates an antenna assembly including two antenna elements according to one embodiment.

In the following description, numerous specific details are set forth. However, it is understood that embodiments of the invention may be practiced without these specific details. In other instances, well-known circuits, structures and techniques have not been shown in detail in order not to obscure the understanding of this description. It will be appreciated, however, by one skilled in the art, that the invention may be practiced without such specific details. Those of ordinary skill in the art, with the included descriptions, will be able to implement appropriate functionality without undue experimentation.

Embodiments of an end-fire antenna assembly are described herein. The antenna assembly may be a multi-band antenna that includes multiple antenna elements electromagnetically resonate in multiple different frequencies. In one embodiment, the antenna assembly includes at least a low-band antenna element and a high-band antenna element. The two antenna elements electromagnetically resonate in two different frequencies (e.g., a low-frequency band and a high-frequency band, respectively). Both antenna elements lie on planes that are parallel to a ground plane. Both antenna elements radiate electromagnetic waves (e.g., wireless signals) propagating in the direction parallel to the ground plate. The low-band antenna element and the high-band antenna element may be coupled to different transceivers; e.g., a low-band transceiver and a high-band transceiver, respectively. Alternatively, the low-band antenna element and the high-band antenna element may be coupled to a transceiver with front-end circuitry supporting two or more frequency bands. The different antenna elements may be disposed on different layers of a multi-layer substrate with a small spacing (e.g., up to a half wavelength of their highest resonant frequency) between the antenna elements. In one embodiment, the antenna assembly includes two or more antenna subarrays. A first antenna subarray includes a plurality of the first antenna elements and a second antenna subarray includes a plurality of the second antenna elements. Each antenna element and each antenna subarray described herein radiate wireless signals in the end-fire direction; i.e., in the direction parallel to the ground plane; more specifically, directions on the X-Y plane as defined in the following description.

For ease of description, the plane on which the ground plane lies is referred to as the X-Y plane, and the thickness of the ground plane is aligned with the Z direction. In one embodiment, the thickness of the substrate (i.e., the Z direction) is much smaller than its length (the X direction) and width (the Y direction). In some conventional systems, antenna elements are disposed across the X-Y plane and radiate wireless signals in the broad-side direction; i.e., the Z direction. There is more room on the X-Y plane of the substrate to spread out broad-side antenna elements than in the thickness dimension (e.g., the Y-Z plane) of the substrate. Embodiments of the antenna assembly described herein arrange end-fire antenna elements on the limited Y-Z plane of the substrate while maximizing cross-band signal isolation and antenna gain. To reduce the footprint of the antenna assembly on the Y-Z plane of the substrate, antenna elements of different frequency bands are stacked along the Z direction. However, stacking these antenna elements in the limited space along the Z direction may cause potential signal isolation problems and reduced antenna gain. Embodiments of the antenna assembly use different types of antenna elements (e.g., the low-band antenna element is a dipole antenna and the high-band antenna element is a loop-shaped antenna) and different shapes of antenna feeders to increase the signal isolation and antenna gain for the antenna elements of different frequency bands stacked in the Z direction.

Thus, the antenna assembly described herein has a compact size suitable for portable wireless devices having a limited form factor. The antenna assembly may be used for millimeter wave communications, such as 5G mobile communications.

In the following description, the term "parallel" is used herein to mean that two lines, layers or planes are parallel or slightly deviated from being parallel. The slight deviation may come from the antenna manufacturing process and is within an allowable tolerance range. Thus, the terms "parallel" and "substantially parallel" are interchangeable in this disclosure to mean that two or more lines, layers, and/or planes are parallel within an allowable tolerance range. Furthermore, the terms "parallel" and "substantially parallel" are also interchangeable in this disclosure to mean that a line of direction and a plane/layer are parallel within an allowable tolerance range.

FIG. 1 illustrates an antenna assembly 100 including two antenna elements according to an embodiment. The antenna assembly 100 includes a first antenna element 110 coupled to a first radio frequency (RF) circuit 115 via a first feeder 116. The antenna assembly 100 further includes a second antenna element 120 coupled to a second RF circuit 125 via a second feeder 126. The first feeder 116 and the second feeder 126 have different geometric shapes. The first RF circuit 115 and the second RF circuit 125 are collectively referred to as the RF circuitry. In one embodiment, the first RF circuit 115 is a first transceiver and the second RF circuit 125 is a second transceiver. Alternatively, the first RF circuit 115 and the second RF circuit 125 are different front-end circuits for different frequency bands in one transceiver.

The first RF circuit 115 and the second RF circuit 125 may be disposed on a circuit block 140. The circuit block 140 may be disposed on a surface of a substrate 150; e.g., the surface facing the (−Z) direction as shown. At least one ground plane 130 is in the substrate 150. The first RF circuit 115 and the second RF circuit 125 are further coupled to a processing circuit 160 for processing incoming and outgoing wireless signals. In one embodiment, the antenna assembly 100 and the ground plane 130 are disposed in the substrate 150, e.g., a multi-layer substrate (which is outlined in dashed lines). The substrate 150 also includes a circuit routing 145 infrastructure which is composed of conducting materials for routing electrical signals between circuit components. The circuit block 140 and the components thereon are assembled on the substrate 150.

The first antenna element 110 and the second antenna element 120 resonate in different frequencies or frequency bands. In one embodiment, the first antenna element 110 radiates RF signals in a first frequency band and the second antenna element 120 radiates RF signals in a second frequency band, where the first frequency band is lower than the second frequency band. Thus, the first antenna element 110 may also be referred to as a low-band antenna element and the second antenna element 120 may also be referred to as a high-band antenna element. In one embodiment, the first antenna element 110 may have a resonance frequency at 28 GHz, and the second antenna element may have a resonance frequency at 39 GHz. In alternative embodiments, the antenna elements 110 and 120 may have other different resonance frequencies. In one embodiment, the widths (in the Y direction) of the first antenna element 100 and the second antenna element 120 may be a half wavelength of their respective resonance frequencies.

Moreover, the first antenna element 110 and the second antenna element 120 radiate RF signals in a direction parallel to the ground plane 130. Thus, the antenna assembly 100 is also referred to an end-fire antenna assembly, and the antenna elements 110 and 120 may be referred to as end-fire antenna elements. For ease of description, the plane on which the ground plane 130 lies is referred to as the X-Y plane. To orient the antenna elements 110 and 120 to radiate in the end-fire direction, the first antenna element 110 is disposed on a first plane and the second antenna element 120 is disposed on a second plane above the first plane, where the first plane and the second plane are parallel to the ground plane 130. In the description herein, the direction "above" or "top" is the direction that perpendicularly points toward the (+Z) direction.

Furthermore, the antenna elements 110 and 120 may be disposed side-by-side with the circuit routing 145, the ground plane 130, and the circuit block 140. A metal wall 170 may be disposed at the interface, dividing the side of the antenna elements 110 and 120 and the side of the circuit block 140, the circuit routing 145, and the ground plane 130. The metal wall 170 may serve as the reflector of the antenna elements 110 and 120 to improve the antenna gain. The metal wall 170 can be formed by a plurality of vias in the substrate 150. The placement and the orientation of the antenna elements 110 and 120 are shown more clearly with the side view in FIG. 2.

Figure 2:
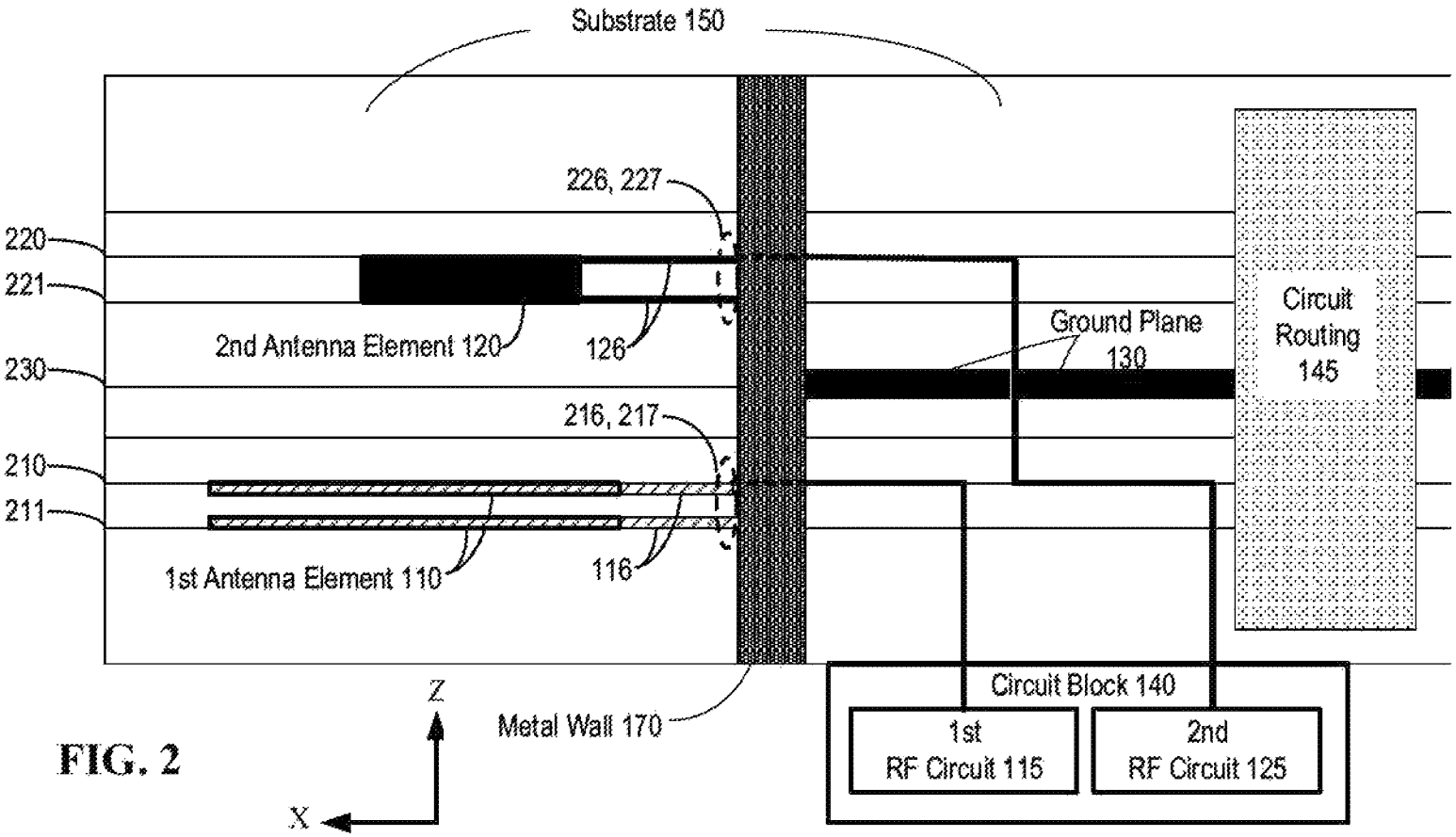
FIG. 2 illustrates a side view of the antenna assembly of FIG. 1 according to one embodiment.

FIG. 2 illustrates a side view of the antenna elements 110 and 120 according to one embodiment. The antenna elements 110 and 120 are disposed in the multi-layer substrate 150. The layers of the substrate 150 are parallel with each other and parallel with the X-Y plane. Each layer is shown in FIG. 2 as a horizontal line across the substrate 150. Each layer contains current-conducting materials. Each of the antenna elements 110 and 120 may be disposed on one, two, or more layers of the substrate 150. In this embodiment, the first antenna element 110 is disposed on a first layer 210 and a second layer 211, and the second antenna element 120 is disposed on a third layer 220 and a fourth layer 221, with the third layer 220 and the fourth layer 221 above or on top of the first layer 210 and second layer 211 in the Z direction. One or more vias may be formed between the layers to allow current-conducting wires to pass through from one layer to another. The area of the substrate 150 between the first antenna element 110 and the second antenna element 120 consists of dielectric materials. In an embodiment where there are three or more antenna elements resonating at different frequencies, the three or more antenna elements may each be disposed on one or more different layers and stacked in the Z direction. The top surfaces of the antenna elements 110 and 120 may be parallel or substantially parallel with the X-Y plane.

FIG. 2 also shows that the first antenna element 110 and the second antenna element 120 have separate feeding ports (216, 217) and (226, 227) (marked in dashed ellipses), respectively, for connecting to the respective feeders 116 and 126. Either or both of feeding ports (216, 217) and feeding points (226, 227) may be single-ended. For example, feeding ports (216, 217) may be single-ended (e.g., feeding port 216 connects to RF signals from the first RF circuit 115 and feeding port 217 connects to ground), and/or feeding ports (226, 227) may be single-ended (e.g., feeding port 226 connects to RF signals from the second RF circuit 125 and feeding port 227 connects to ground). Alternatively, either or both of feeding ports (216, 217) and feeding points (226, 227) may be a differential pair. For example, feeding ports 216 and 217 connect to RF+ and RF− signal from the first RF circuit 115, respectively, and/or feeding ports 226 and 227 connect to RF+ and RF− signals from the second RF circuit 125, respectively. The feeding ports (216, 217) and (226, 227) may be the same type of port or different types of ports.

The ground plane 130 spans on the X-Y plane. The ground plane 130 is disposed side-by-side with the antenna elements 110 and 120. More specifically, the Z-direction projections of the antenna elements 110 and 120 fall in an area next to, and non-overlapping with, the ground plane 130. Each of the ground plane 130, the circuit routing 145 and the metal wall 170 is disposed in one or more of the layers in the multi-layer substrate 150. In the embodiment of FIG. 2, the ground plane is disposed on the layer 230. In one alternative embodiment, one of the layers on which the antenna element (110 or 120) is disposed may be the layer 230, the same layer on which the ground plane is disposed.

Although this disclosure describes various embodiments in which the second antenna element 120 is stacked on top of (or substantially on top of) the first antenna element 110, in alternative embodiments the first antenna element 110 may be stacked on top of (or substantially on top of) the second antenna element 120.

Figure 3:
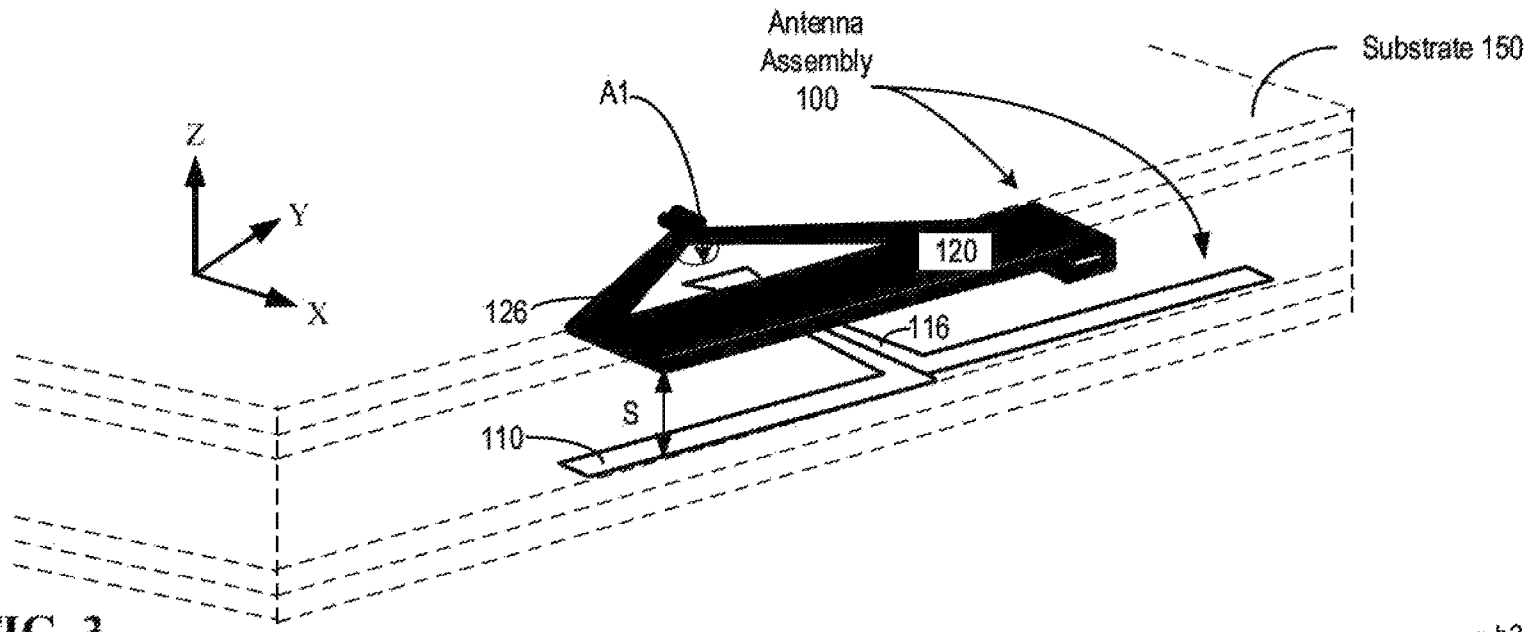
FIG. 3 illustrates a perspective view of the antenna assembly of FIG. 1 according to one embodiment.

FIG. 3 illustrates a perspective view of the antenna assembly 100 according to one embodiment. This perspective view more clearly shows that the first feeder 116 and the second feeder 126 have different shapes. More specifically, the second feeder 126 includes two line elements that form a fork with angle A1 toward the second antenna element 120. Angle A1 may be any angle between, non-inclusively, 0 and 180 degrees. In contrast, the two line elements of the first feeder 116 are parallel to each other; that is, 180 degrees between the two line elements. A designer may choose angle A1 such that angle A1 is different from the angle between the two line elements of the first feeder 116. The difference between the two angles improves isolation between the two antenna elements 110 and 120, thereby improving the antenna gain.

In one embodiment, the first antenna element 110 and the second antenna element 120 may be different types of antennas and have different antenna shapes. For example, the first antenna element 110 may be a dipole antenna, and the second antenna element 120 may be a folded dipole antenna, a loop antenna, or another loop-based antenna. In an alternative embodiment, the first antenna element 110 may be a folded dipole antenna, a loop antenna, or another loop-based antenna, and the second antenna element 120 may be a dipole antenna.

FIG. 3 also shows a spacing S between the first antenna element 110 and the second antenna element 120. S denotes the vertical distance, in the Z direction, between the two antenna elements 110 and 120. S is smaller than the height (i.e., thickness) of the substrate 150. A typical substrate, such as the substrate 150, has a thickness (in the Z direction) much smaller than its length (in the X direction) and width (in the Y direction).

The spacing S may be determined at the antenna design time based on the frequency range(s) and the corresponding wavelengths for which the antenna elements provide. In one embodiment, S may be a non-zero value less than or equal to $\lambda_d/2$, wherein $\lambda_d$ is the highest resonant frequency of the first antenna element 110 and the second antenna element 120.

Figure 4:
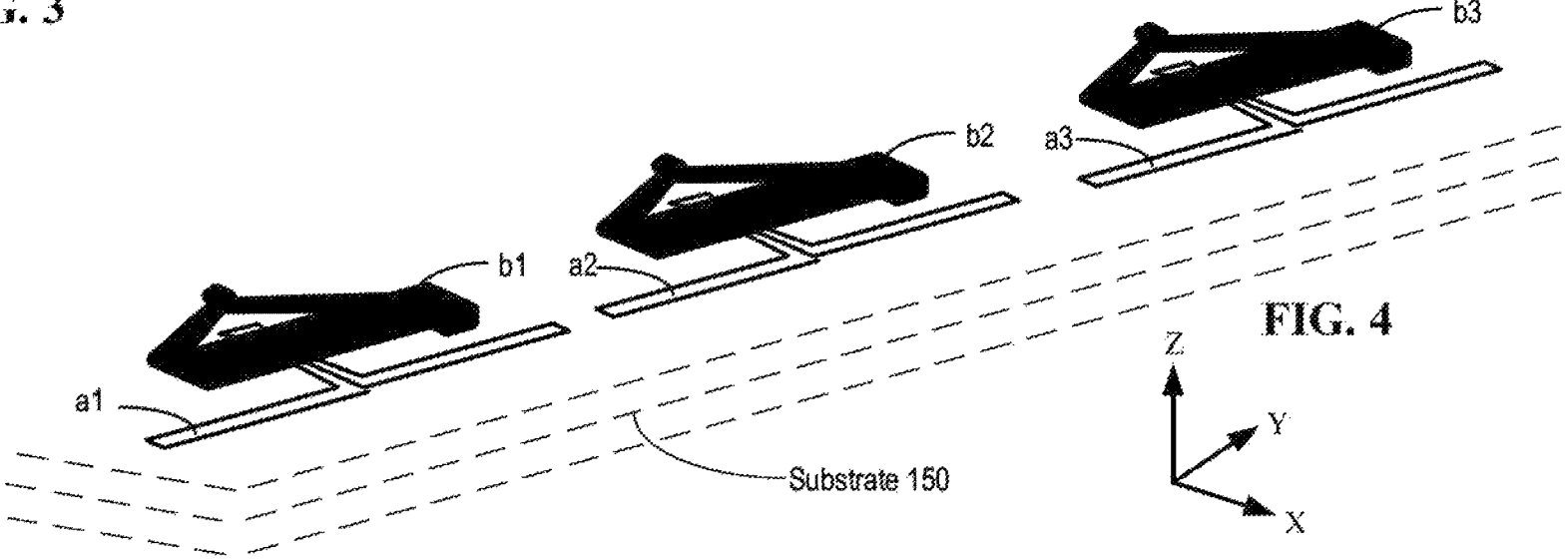
FIG. 4 illustrates a perspective view of an antenna assembly including two antenna subarrays according to one embodiment.

FIG. 4 illustrates a perspective view of an antenna assembly including two antenna subarrays (a1-a3 and b1-b3) according to one embodiment. The first antenna subarray includes antenna elements a1-a3, each of which may be the first antenna element 110 in FIGS. 1-3. The second antenna subarray includes antenna elements b1-b3, each of which may be the second antenna element 120 in FIGS. 1-3. Each antenna element (a1, a2, a3, b1, b2, or b3) may have the same orientation and shape, and operates in the same frequency or frequency band as the corresponding antenna element 110 or 120. In alternative embodiments, the number of antenna elements in each subarray may be any plural number different from three.

In this embodiment, the antenna elements (a1-a3 or b1-b3) in each subarray form an equidistant linear array that spans in the width (Y) direction. Stacking the second antenna subarray (b1-b3) on top of the first antenna subarray (a1-a3) significantly reduces the footprint of the antenna assembly as compared to spreading all antenna elements (a1-a3 and b1-b3) on the same plane along the width (Y) direction. In an alternative embodiment, the first antenna subarray (a1-a3) may be stacked on top of the second antenna subarray (b1-b3).

Furthermore, all of the antenna elements a1-a3 in the first antenna subarray have a first polarization, and all of the antenna elements b1-b3 in the second antenna subarray have a second polarization. The first polarization may be the same as, or different from, the second polarization.

Figure 5:
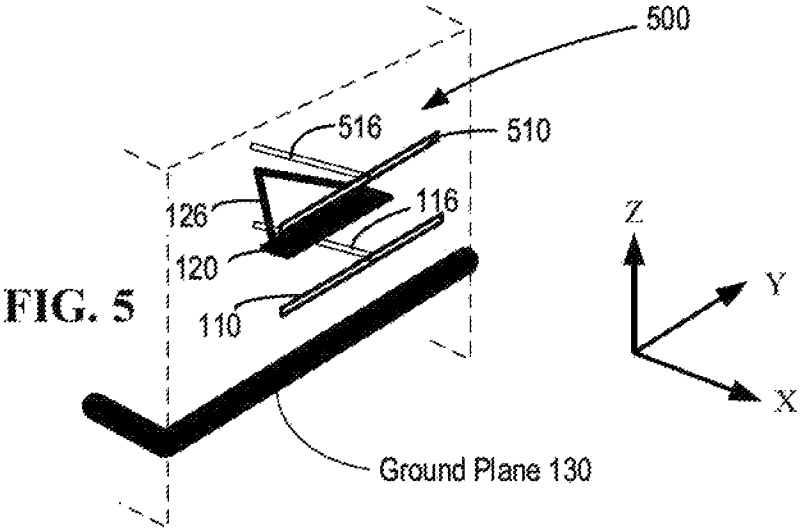
FIG. 5 illustrates a perspective view of a multi-band antenna assembly including three antenna elements according to one embodiment.

FIG. 5 illustrates a perspective view of an antenna assembly 500 including three antenna elements 110, 120 and 510 according to one embodiment. The three antenna elements 110, 120 and 510 radiate in three different frequencies or frequency bands; e.g., the antenna element 110 operates in a low-frequency band, the antenna element 120 operates in a middle-frequency band and the antenna element 510 operates in a high-frequency band, where the terms "low," "middle" and "high" denote frequency ranges relative to one another in the frequency spectrum. The three antenna elements 110, 120 and 510 radiate in an end-fire direction; i.e., the direction parallel to the ground plane 130. The immediately adjacent two antenna elements (e.g., (110 and 120), and (120 and 510)) in the Z direction are coupled to feeders of different shapes. For example, the feeder 116 of the antenna elements 110 includes two parallel line elements. The feeder 126 of the antenna element 120 includes two line elements that fork toward the antenna element 120 at an angle between 0-180 degrees, non-inclusively. The feeder 516 may have the same shape as the feeder 116. In an alternative embodiment, the feeder 516 may have a shape different from the feeder 116 and the feeder 126.

Furthermore, the immediately adjacent two antenna elements (e.g., (110 and 120), and (120 and 510)) in the Z direction are different types of antennas. As mentioned before, the first antenna element 120 may be a dipole antenna, and the second antenna element 110 may be a folded dipole antenna, a loop antenna, or another loop-based antenna. The third antenna element 510 may also be a dipole antenna. An alternative embodiment of an antenna assembly may include more than three antenna elements, each radiating in a different frequency band in the end-fire direction. In such an antenna assembly, any two immediately adjacent antenna elements (where the adjacency is in the Z direction) are different types of antennas and are coupled to different shapes of feeders. Antenna elements that are not immediately adjacent in the Z direction may be the same type of antenna and coupled to feeders of the same shape.

Although not shown in the figures herein, an antenna assembly may include three or more antenna subarrays, where the antenna elements in each subarray form an equidistant linear array that spans in the width (Y) direction, and the antenna elements of different subarrays are disposed on different parallel planes or in different parallel layers. For example, the antenna assembly 500 in FIG. 5 may be replicated a number of times and placed along the Y direction of the substrate. The corresponding antenna elements in the three subarrays may be stacked on top of one another as shown in the three-antenna-element stack in FIG. 5. A similar construction is applicable to an antenna assembly having more than three antenna subarrays.

Figure 8A:
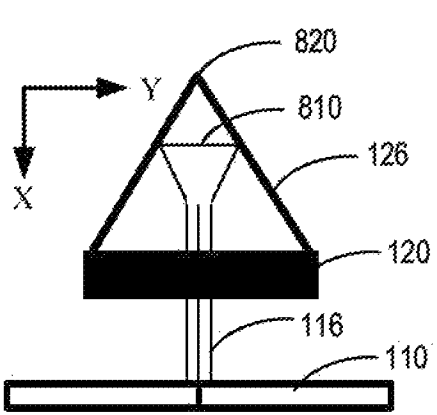
FIG. 8A illustrates a top view of two antenna elements with an offset in a second direction according to one embodiment.
Figure 8B:
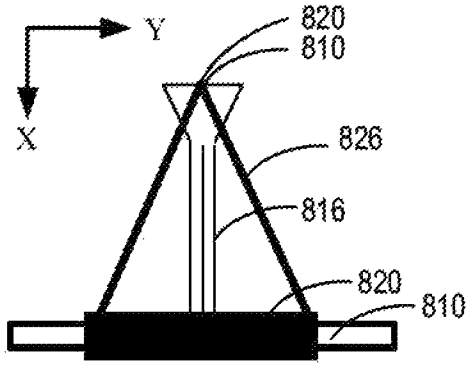
FIG. 8B illustrates a top view of two antenna elements with another offset in a second direction according to one embodiment.
Figure 7:
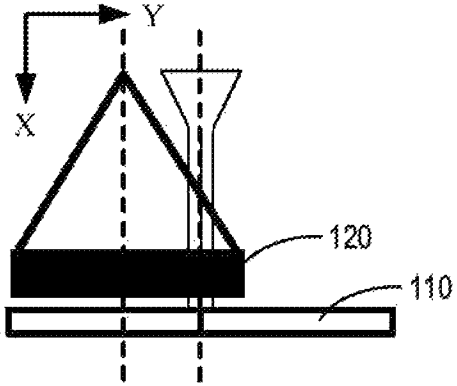
FIG. 7 illustrates a top view of two antenna elements with an offset in a first direction according to one embodiment.
Figure 6:
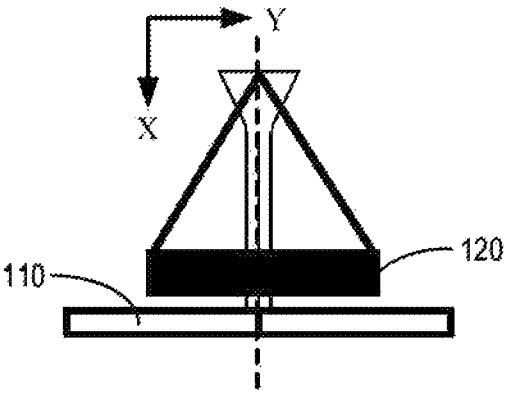
FIG. 6 illustrates a top view of the two antenna elements of FIG. 1 according to one embodiment.

FIG. 6 illustrates a top view of the two antenna elements 110 and 120 of FIG. 1 according to one embodiment. This top view shows that the two antenna elements 110 and 120 are aligned in the middle of their respective width (Y) dimensions. That is, the respective middle lines (shown as a dotted line) of their respective width (Y) dimensions are on top of (i.e., aligned with) each other. FIG. 7 illustrates a top view of the two antenna elements 110 and 120 with an offset in the Y (or −Y) direction according to one embodiment. That is, the middle lines (shown as two dotted lines) of their respective width (Y) dimensions are not on top of each other. FIG. 8A illustrates a top view of the two antenna elements 110 and 120 with an offset in the X (or −X) direction according to one embodiment. That is, endpoints (810, 820) of their respective feeders (116, 126) are not on top of each other. In some designs, the offset may be used to increase isolation between the antenna elements. FIG. 8B illustrates a top view of the two antenna elements 110 and 120 with another offset in the X (or −X) direction according to one embodiment. The feeder 816 or 826 may be lengthened or shortened in the X (or −X) direction by an offset compared to its counterpart 116 or 126, such that the endpoints (810, 820) are aligned when viewed from the top.

In one embodiment, an antenna assembly that includes two or more subarrays may use the arrangements shown in FIGS. 6-8. For example, the antenna subarrays (a1-a3 and b1-b3) may be arranged to be aligned with respect to their respective width (Y) dimensions for each corresponding pair of first and second antenna elements 110, 120 as in FIG. 6. Alternatively, the antenna subarrays (a1-a3 and b1-b3) may be arranged to have an offset in the Y direction or in the X direction respect to their respective width (Y) dimensions for each corresponding pair of first and second antenna elements 110, 120 as in FIG. 7 or FIG. 8.

Figure 9:
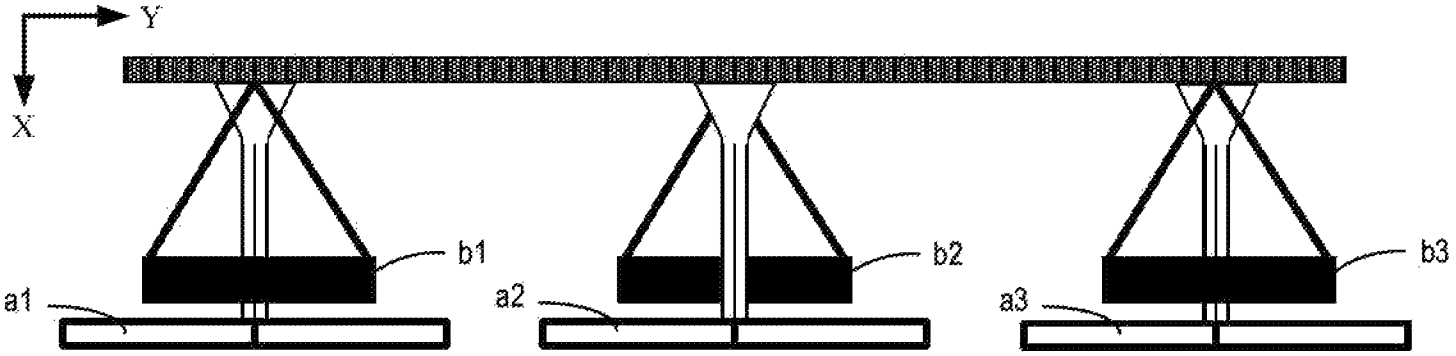
FIG. 9 illustrates a top view of two interleaved antenna subarrays according to one embodiment.

FIG. 9 illustrates a top view of an antenna assembly including two interleaved antenna subarrays (a1-a3 and b1-b3) according to one embodiment. The antenna elements a1-a3 and b1-b3 may be the same antenna elements as in FIG. 4. The first antenna subarray (a1-a3) interleaves with the second antenna subarray (b1-b3) such that, in a direction parallel to the ground plane (e.g., the Y direction), any two antenna elements that are immediately adjacent to each other include one of the first antenna elements and one of the second antenna elements. That is, the antenna elements of the same antenna subarray are not all disposed on the same plane. For example, the antenna elements a1, b2 and a3 are on the same plane, and the antenna elements b1, a2 and b3 are on the same plane. That is, the two antenna subarrays are interleaved. The interleaving is applicable to an antenna assembly having more than two subarrays, and each subarray may include any numbers of antenna elements. To enhance signal isolation and improve the antenna gain, the interleaved antenna assembly maintains that different types of antennas and different shapes of feeders are used for any immediately adjacent two antenna elements in the Z direction.

Figure 10:
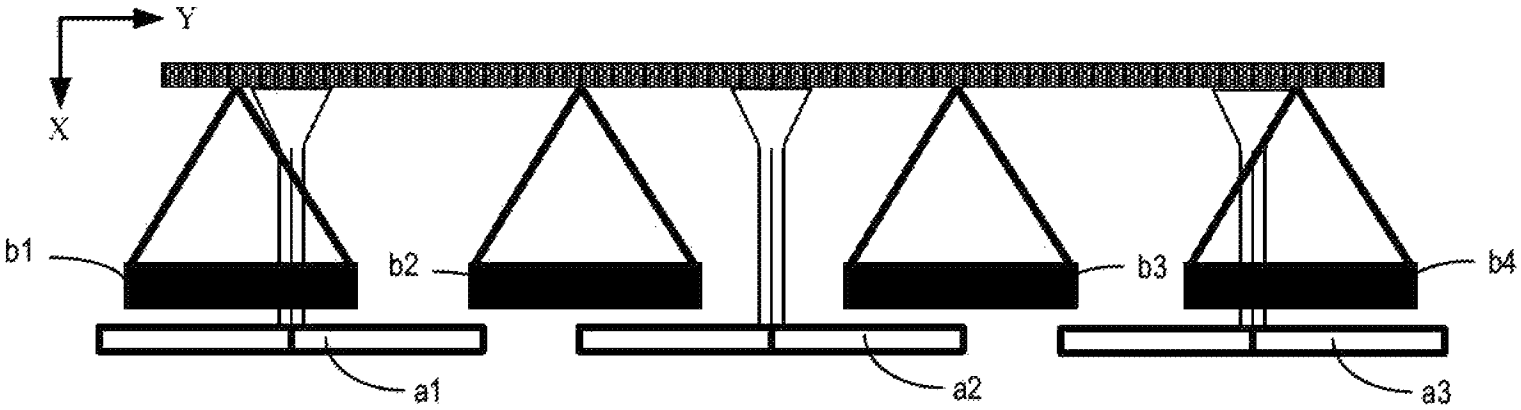
FIG. 10 illustrates a top view of two antenna subarrays with different numbers of antenna elements according to one embodiment.

FIG. 10 illustrates a top view of two antenna subarrays (a1-a3 and b1-b4) with different numbers of antenna elements according to one embodiment. The antenna elements in each subarray form an equidistant linear array that spans in the width (Y) direction. Each of the antenna elements a1-a3 may be the first antenna element 110 in FIGS. 1-3. Each of the second antenna subarray (b1-b4) may be the second antenna element 120 in FIGS. 1-3. The antenna elements of the same subarray are disposed on the same plane parallel to the ground plane 130, and the antenna elements of different subarrays are disposed on different parallel planes. In this embodiment, the second antenna subarray (b1-b4) includes more antenna elements than the first antenna subarray. In an alternative embodiment, the first antenna subarray may include more antenna elements than the second antenna subarray. In an alternative embodiment, each antenna subarray may include any number of the same antenna elements.

Figure 11:
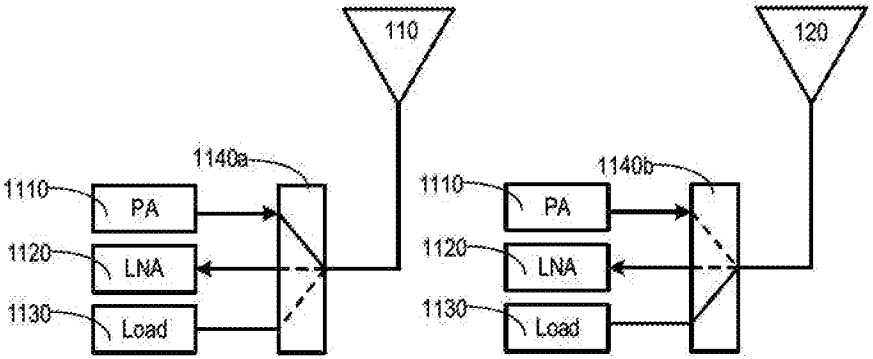
FIG. 11 is a schematic diagram of two antenna elements, each coupled to a three-terminal switch according to one embodiment.

FIG. 11 is a schematic diagram of the antenna elements 110 and 120, each coupled to a three-terminal switch (1140*a* or 1140*b*) according to one embodiment. The three terminals of the switch 1140*a*, 1140*b* are coupled to a power amplifier (PA) 1110 to amplify outgoing signals in the transmission path, a low-noise amplifier (LNA) 1120 to amplify incoming signals in the receiving path, and a load 1130. The load 1130 is optimized with respect to at least the impedance to minimize the interference caused by an antenna element not in active operation (i.e., not transmitting or receiving signals). For example, the switch 1140*a* connects the antenna element 110 to the PA 1110 when the antenna element 110 is transmitting a signal; at the same time the switch 1140*b* connects the antenna element 120, which is not transmitting or receiving, to the load 1130. Thus, when a low-band antenna element is in a transmit or receive state, the high-band antenna element is connected to the load 1130, and vice versa. Connecting the non-active antenna element to an optimized load (e.g., open or short) can reduce interference and improve the antenna gain of the active antenna element. In one embodiment, the three-terminal switches 1140*a*, 1140*b* and the optimized load 1130 may be used in addition to the aforementioned different antenna types and different feeder shapes in connection with the first antenna element 110 and the antenna element 120.

Figure 12:
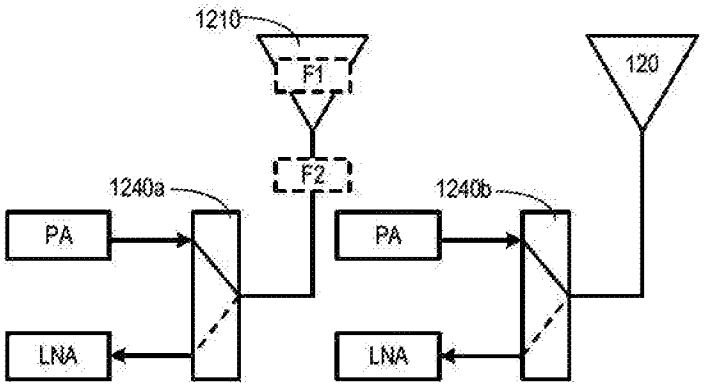
FIG. 12 is a schematic diagram of two antenna elements using a filter to enhance signal isolation according to one embodiment.

FIG. 12 is a schematic diagram of two antenna elements using a filter (e.g., a low pass filter) to enhance signal isolation according to one embodiment. In this embodiment, a low-band antenna element 1210 operates in a frequency band which is the same or substantially the same as the aforementioned first antenna element 110. Each of the antenna elements (1210 and 120) is coupled to a PA or an LNA via a two-terminal switch 1240*a* or 1240*b*. In one embodiment, the low-band antenna element 1210 is integrated with a low-pass filter F1. In an alternative embodiment, the low-band antenna element 1210 is coupled to a low-pass filter F2 on the signal path to/from the RF circuitry. The pass-band of the low-pass filters F1 or F2 does not overlap with the second frequency band at which the second antenna element 120 operates. Adding a low-pass filter, such as F1 or F2, can improve the isolation between the two antenna elements 1210 and 120 at the expense of an insignificant amount of insertion loss. The high-band antenna element, such as the antenna element 120, may use an antenna type and a feeder shape different from those of the antenna element 1210, as mentioned before in connection with the first antenna element 110 and the antenna element 120.

Figure 13:
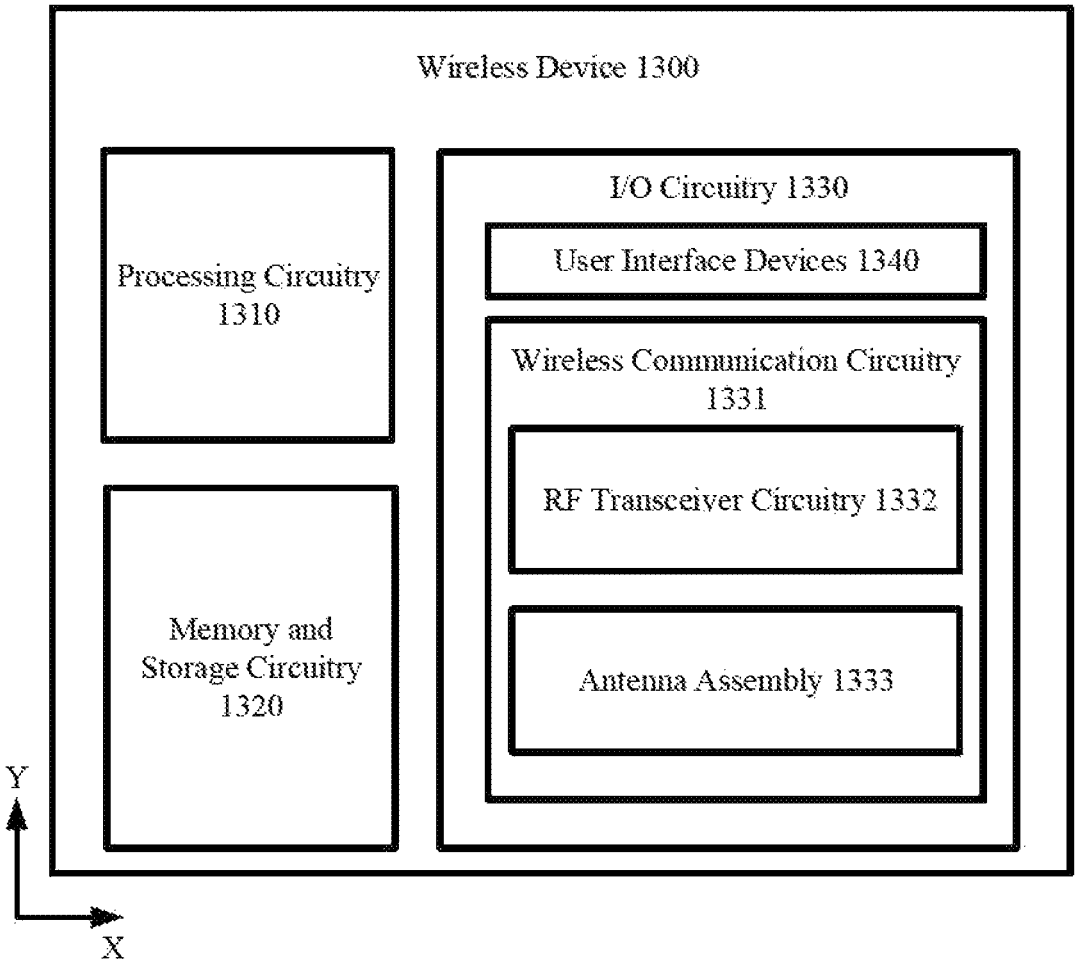
FIG. 13 illustrates a wireless device according to one embodiment.

FIG. 13 illustrates an example of a wireless device 1300 according to one embodiment. The wireless device 1300 may include any of the aforementioned antenna assemblies or their variations for transmitting and/or receiving wireless signals. The wireless device 1300 includes processing circuitry 1310, which may further include one or more of: arithmetic and logic units (ALUs), control circuitry, cache memory, and/or other processing circuitry. Non-limiting examples of the wireless device 1300 include smartphones, smartwatches, tablets, laptops, Internet-of-things (IoT) devices, navigation devices, multimedia devices, and other computing and/or communication devices having wireless communication capabilities.

The wireless device 1300 further includes memory and storage circuitry 1320 coupled to the processing circuitry 1310. The memory and storage circuitry 1320 may include memory devices such as dynamic random access memory (DRAM), static RAM (SRAM), flash memory and other volatile or non-volatile memory devices. The memory and storage circuitry 1320 may further include storage devices, for example, any type of solid-state, magnetic and/or optical storage device.

The wireless device 1300 also includes input/output (I/O) circuitry 1330 which may further include user interface devices 1340, such as one or more of: a display, a speaker, a microphone, a camera, touch sensors, buttons, a keyboard and/or a keypad, etc. The I/O circuitry 1330 further include wireless communication circuitry 1331 for communicating wirelessly with external systems. The wireless communication circuitry 1331 may include radio-frequency (RF) transceiver circuitry 1332 for handling various RF communication bands used in one or more of: WiFi, Bluetooth, cellular, Global Positioning System (GPS), millimeter wave, any short-range and/or long-range networks. In one embodiment, the wireless communication circuitry 1331 includes an antenna assembly 1333 coupled to the RF transceiver circuitry 1332. The antenna assembly 1333 may include the aforementioned antenna elements, antenna subarrays and/or their variations; e.g., the end-fire antenna elements and the end-fire antenna subarrays shown and/or described with reference to FIGS. 1-12.

In one embodiment, the RF transceiver circuitry 1332 is disposed on a ground plane (not shown) which is parallel to the X-Y plane. The antenna assembly 1333 radiates in two or more frequency bands in the end-fire direction; i.e., in a direction parallel to the X-Y plane. In one embodiment, the antenna assembly 1333 may additionally include broad-side antenna elements and/or antenna subarrays radiating in two or more frequency bands in a direction perpendicular to the X-Y plane.

While the invention has been described in terms of several embodiments, those skilled in the art will recognize that the invention is not limited to the embodiments described, and can be practiced with modification and alteration within the spirit and scope of the appended claims. The description is thus to be regarded as illustrative instead of limiting.

What is claimed is:

1. An antenna assembly, comprising:

a first antenna element coupled to RF circuitry via a first feeder; and a second antenna element coupled to the RF circuitry via a second feeder, wherein the first antenna element and the second antenna element radiate in different frequency bands and in a direction parallel to a ground plane, the ground plane disposed on at least one layer in a substrate that includes a plurality of layers parallel to one another, and a metal wall dividing a first side of the substrate including the RF circuitry and a second side of the substrate including the first antenna element and the second antenna element, wherein the first antenna element is disposed on first one or more of the layers and the second antenna element is disposed on second one or more of the layers, which are different from the first one or more of the layers, wherein the first antenna element and the second antenna element are stacked in a perpendicular direction with respect to the ground plane, and wherein one of the first antenna element and the second antenna element is a dipole antenna, and the other one of the first antenna element and the second antenna element is a loop-shaped antenna or a folded dipole antenna.

2. The antenna assembly of claim 1, wherein projections of the first antenna element and the second antenna element, in a direction perpendicular to the ground plane, fall in an area next to the ground plane.

3. The antenna assembly of claim 1, wherein the first antenna element and the second antenna element are different types of antennas.

4. The antenna assembly of claim 1, wherein the first feeder a two line elements of the first feeder are parallel to each other, and the other two line elements of the second feeder fork toward the second antenna element.

5. The antenna assembly of claim 1, further comprising:

a plurality of antenna elements operative to radiate in respective frequency bands that are different from one another in a direction parallel to the ground plane, wherein the plurality of antenna elements are stacked along a perpendicular direction with respect to the ground plane, wherein immediately adjacent two of the plurality of antenna elements in the perpendicular direction have different antenna types and are coupled to feeders of different shapes.

6. The antenna assembly of claim 1, wherein each of the first antenna element and the second antenna element is coupled to a three-terminal switch, and wherein when one of the first antenna element and the second antenna element is in a transmit or receive state, the three-terminal switch connects the other one of the first antenna element and the second antenna element to a load.

7. The antenna assembly of claim 1, wherein a low-band antenna element, which is one of the first antenna element and the second antenna element, is coupled to or integrated with a filter.

8. The antenna assembly of claim 1, wherein each of the first antenna element and the second antenna element is connected to feeding ports which are single-ended or form a differential pair.

9. The antenna assembly of claim 1, wherein a vertical distance, in a direction parallel to the ground plane, between the first antenna element and the second antenna element is a non-zero value less than or equal to $\lambda_d/2$, wherein $\lambda_d$ is a highest resonant frequency of the first antenna element and the second antenna element.

10. The antenna assembly of claim 1, wherein the metal wall is formed by a plurality of vias.

* * * * *